US012721383B1

(12) United States Patent
Lazic

(10) Patent No.: US 12,721,383 B1
(45) Date of Patent: Sep. 1, 2026

(54) LOWER BODY GARMENTS AND POCKETS FOR SAME

(71) Applicant: LULULEMON ATHLETICA CANADA INC., Vancouver (CA)

(72) Inventor: Natasa Lazic, Vancouver (CA)

(73) Assignee: Lululemon Athletica Canada Inc., Vancouver (CA)

( * ) Notice: Subject to any disclaimer, the term of this patent is extended or adjusted under 35 U.S.C. 154(b) by 0 days.

(21) Appl. No.: 19/400,940

(22) Filed: Nov. 25, 2025

(51) Int. Cl.

| | |
|---|---|
| ***A41D 1/089*** | (2018.01) |
| ***A41D 1/06*** | (2006.01) |
| ***A41D 27/02*** | (2006.01) |
| ***A41D 27/20*** | (2006.01) |
| ***A41D 31/18*** | (2019.01) |
| *A41D 31/02* | (2019.01) |

(52) U.S. Cl.
CPC ..... *A41D 1/06* (2013.01); *A41D 27/02* (2013.01); *A41D 27/20* (2013.01); *A41D 31/18* (2019.02)

(58) Field of Classification Search
CPC ..... A41D 1/06; A41D 27/02; A41D 27/20; A41D 31/18
See application file for complete search history.

(56) References Cited

U.S. PATENT DOCUMENTS 2,075,680 A * 3/1937 Weinberg ..... A41F 9/02 2/247
2,725,573 A * 12/1955 Kornhauser ..... A41D 27/202 2/247
2,899,684 A * 8/1959 Riley ..... A41D 27/207 2/254
2,930,046 A * 3/1960 Sagner ..... A41D 27/20 2/247
3,137,862 A * 6/1964 Mizerak ..... A41D 27/20 2/400
3,409,912 A * 11/1968 Hyman ..... A41D 27/20 2/253
3,772,708 A * 11/1973 Segelin ..... A41D 27/20 2/253
4,139,914 A * 2/1979 Tarr ..... A41D 27/20 224/587
4,428,080 A * 1/1984 Takamatsu ..... A41D 1/06 2/247
5,255,392 A * 10/1993 Stanislaw ..... A41D 27/208 2/403
5,664,256 A * 9/1997 Blauer ..... A41D 27/04 2/69

(Continued)

*Primary Examiner* — Robert H Muromoto, Jr.
(74) *Attorney, Agent, or Firm* — Norton Rose Fulbright Canada LLP; Thomas Sutherland

(57) ABSTRACT

According to an aspect, there is provided a lower body garment and method of making same. The lower body garment includes a waistband, a liner, a shell, and a pocket. The pocket includes a pocket bag that includes a back pocket panel formed from a liner pocket portion or attached to the liner pocket portion, a front pocket panel opposite the back pocket panel, a pocket opening along an edge of the front pocket panel and proximate to a shell upper edge pocket portion, and a closed pocket perimeter attaching the front pocket panel and the back pocket panel to each other and defining closed edges of the pocket bag. The lower body garment includes a waistband seam that connects a pocket portion of a waistband lower edge with the back pocket panel. The pocket opening is positioned along a portion of the waistband seam.

20 Claims, 7 Drawing Sheets

(56) References Cited

U.S. PATENT DOCUMENTS 9,271,532 B2 * 3/2016 Cole ..... A41D 1/089
9,474,655 B1 * 10/2016 Biondolillo ..... A41B 9/04
11,324,265 B2 * 5/2022 Holmes ..... A41F 9/00
11,684,102 B2 * 6/2023 Lazic ..... A41D 27/20 2/69
11,700,897 B2 * 7/2023 Lazic ..... A41D 27/204 2/247
12,262,760 B1 * 4/2025 Crespo ..... A61F 13/496
12,310,439 B2 * 5/2025 Yaremenko ..... A41C 3/0035
2012/0210495 A1 * 8/2012 Wilson ..... A41F 9/025 2/236
2012/0311758 A1 * 12/2012 Nicholson ..... A41D 27/20 2/400
2012/0311761 A1 * 12/2012 Luginbuhl ..... A41D 1/002 2/69
2013/0305433 A1 * 11/2013 Hedrick ..... A41D 31/185 2/220
2014/0182044 A1 * 7/2014 Cole ..... A41D 1/089 2/69
2015/0007379 A1 * 1/2015 Cockram ..... A41D 13/0015 2/236
2015/0089708 A1 * 4/2015 Trevino ..... A41D 13/0012 2/69
2015/0366280 A1 * 12/2015 Fay ..... A41D 27/205 2/248
2016/0007662 A1 * 1/2016 Powell ..... A41D 1/089 2/228
2016/0120251 A1 * 5/2016 Grafenstein-Kinzel ..... A41F 9/002 2/300
2016/0331053 A1 * 11/2016 Gordon ..... A41D 7/00
2017/0172239 A1 * 6/2017 Staub ..... A41B 1/08
2017/0238634 A1 * 8/2017 Berns ..... A41D 27/207
2017/0258158 A1 * 9/2017 Baiany ..... A41D 31/125
2018/0035736 A1 * 2/2018 Le ..... A41D 27/204
2019/0297972 A1 * 10/2019 Holmes ..... A41F 9/025
2019/0373969 A1 * 12/2019 Bolker ..... A41D 1/002
2022/0248773 A1 * 8/2022 Ambelang ..... A41F 17/00
2025/0098802 A1 * 3/2025 Anson ..... A41D 27/20
2025/0288038 A1 * 9/2025 Crocker ..... A41D 27/204
2026/0041174 A1 * 2/2026 Deurloo ..... A41D 1/089

* cited by examiner

LOWER BODY GARMENTS AND POCKETS FOR SAME

FIELD

Embodiments of the present disclosure generally relate to the field of garments, and more specifically, embodiments relate to devices, systems, and methods for improved storage and support for athletic lower body garments.

INTRODUCTION

Garments (e.g., athletic garments and garments configured for activities) may provide support for the wearer during activities. These athletic garments can include, for example, shorts, pants, leggings, and other lower body garments. In addition to support, some features may exist within the garment to provide additional functionality for the wearer. For example, the garment may contain pockets so that the wearer can carry items with them as they undertake their activities (e.g., hold their keys or phone while they run).

SUMMARY

The presence of pockets in lower body garments may not provide a comfortable experience for the wearer, particularly during athletic activities such as running. The movement of the wearer can cause the pocket contents to repeatedly bang against or dig into the same area of the wearer's body. It also may be difficult for the wearer to access the pocket during movement.

Described herein are lower body garments with functional features that can improve the wearer's experience, the garment silhouette, and/or security. These features may be especially beneficial during active use (e.g., running, playing sports, exercise, etc.). The lower body garments described herein may combine the performance benefits of a liner (which may provide warmth, moisture wicking, compression, support, etc.) with the benefits of a shell (which may provide modesty). The lower body garments described herein may further provide the wearer with a pocket that can be easily accessed through the shell without causing the wearer to expose themselves. The lower body garment may provide a pocket for the wearer which may generally conform to the liner and be concealed by the shell. Positioning the pocket against or as part of the liner may ensure that the pocket is jostled less during active user (e.g., during running). The pocket opening may be provided under the waistband, for example, within the waistband seam connecting the shell and the waistband. Furthermore, positioning the pocket opening along the waistband seam may conceal any closures (e.g., a zipper) which may make the pocket less obvious and disruptive to the wearer's silhouette.

According to an aspect, there is provided a lower body garment including a waistband configured to be positioned around a waist of a wearer, a liner defining an innermost surface of the lower body garment, a shell defining an outermost surface of the lower body garment and covering at least a portion of the liner below the waistband lower edge, and a pocket configured to contain contents in the lower body garment. The waistband includes a waistband upper edge and a waistband lower edge. The waistband upper edge defines a waist opening of the lower body garment. The waistband lower edge comprises a waistband lower edge pocket portion and a waistband lower edge non-pocket portion. The liner is configured to cover a lower torso area below a waist area of a wearer. The liner includes a liner pocket portion. The shell includes a shell upper edge. The shell upper edge includes a shell upper edge pocket portion and a shell upper edge non-pocket portion. The pocket includes a pocket bag that includes a back pocket panel formed from the liner pocket portion or attached to the liner pocket portion, a front pocket panel opposite the back pocket panel, a pocket opening along an edge of the front pocket panel and proximate to the shell upper edge pocket portion, and a closed pocket perimeter attaching the front pocket panel and the back pocket panel to each other and defining closed edges of the pocket bag. The pocket bag is configured to contain the contents in an area between the front pocket panel and the back pocket panel within the closed pocket perimeter. The lower body garment includes a waistband seam. The waistband seam includes a waistband seam pocket portion and a waistband seam non-pocket portion. The waistband seam non-pocket portion connects the waistband lower edge non-pocket portion with the shell upper edge non-pocket portion. The waistband seam pocket portion connects the waistband lower edge pocket portion with the back pocket panel. The front pocket panel is positioned between an inward-facing surface of the back pocket panel and an opposing inward-facing surface of the shell. An upper edge of the front pocket panel is attached to the shell upper edge pocket portion. The pocket opening is positioned along the waistband seam pocket portion. The pocket opening is configured to provide access to the pocket bag from the outermost surface of the shell.

In some embodiments, the liner includes a first elastic textile having a stretch axis aligned with the waist opening. In some embodiments, the liner includes a first pair of leg portions, each of the first pair of leg portions includes a bottom opening, and the each of the first pair of leg portions is configured to be positioned around a leg of a wearer during wear of the garment.

In some embodiments, the liner includes a liner upper portion and a liner body portion extending below the liner upper portion. In some embodiments, the liner upper portion extends beyond the closed pocket perimeter at least to left and right side seams of the lower body garment and is attached to left and right side seams of the lower body garment. In some embodiments, the liner upper portion extends at least partially around a waistband perimeter of the lower body garment and is configured to at least partially encircle a waist area of a wearer. In some embodiments, the liner upper portion is configured to fully encircle a waist area of a wearer. In some embodiments, the liner body portion includes a first pair of leg portions.

In some embodiments, the shell includes a shell upper portion and a shell body portion extending below the shell upper portion. The shell upper portion at least partially covers the liner upper portion and includes the shell upper edge. In some embodiments, the shell body portion includes a second pair of leg portions, each of the second pair of leg portions includes a bottom opening, and the each of the second pair of leg portions is configured to be positioned around a leg of a wearer during wear of the garment.

In some embodiments, the back pocket panel is formed from the liner pocket portion. The liner includes a first elastic textile having an axis of stretch aligned with the waist opening, and the front pocket panel includes a second elastic textile having an axis of stretch aligned with the waist opening. In some embodiments, a level of stretch of the first elastic textile and of the second elastic fabric along the axis are within 20 percent of each other.

In some embodiments, the back pocket panel is attached to the liner. The liner includes a first elastic textile having an axis of stretch aligned with the waist opening, and the front pocket panel includes a second elastic textile having an axis of stretch aligned with the waist opening. In some embodiments, a level of stretch of the first elastic textile and of the second elastic textile along the axis are within 20 percent of each other.

In some embodiments, the pocket opening includes a closure movable between an open position and a closed position. In some embodiments, the closure is a two-sided closure, and a first side of the closure is attached to the waistband lower edge pocket portion and a second side of the closure is attached to the shell upper edge pocket portion. In some embodiments, the two-sided closure is a zipper, a hook-and-loop closure, a snap.

In some embodiments, the waistband includes a waistband outer layer defining an outermost surface of the waistband and the waistband outer layer wraps over the waistband upper edge.

In some embodiments, the waistband outer layer forms a drawcord channel, the waistband includes a drawcord in the drawcord channel, and the drawcord channel includes a drawcord opening configured to provide access to the drawcord. In some embodiments, the drawcord channel formed by the waistband outer layer is along an exterior perimeter of the waistband or is along an interior perimeter of the waistband. In some embodiments, the drawcord channel is along the interior perimeter of the waistband and the drawcord opening is on an innermost surface of the waistband.

In some embodiments, the waistband includes a waistband inner layer defining an innermost surface of the waistband. In some embodiments, the waistband inner layer forms a drawcord channel along an interior perimeter of the waistband, the waistband includes a drawcord in the drawcord channel, and the drawcord channel includes a drawcord opening configured to provide access to the drawcord. In some embodiments, the drawcord opening is on the innermost surface of the waistband.

In some embodiments, the waistband includes a length of elastic tape extending circumferentially around the waist opening. In some embodiments, the elastic tape is positioned behind a waistband outer layer, or is positioned in front of a waistband inner layer, or is positioned between a waistband outer layer and a waistband inner layer. In some embodiments, the length of elastic tape comprises two layers forming an open passage between the two layers positioned along a lower edge of the elastic tape. In some embodiments, the length of elastic tape is a length of elastic tape having a Y-shaped bottom edge.

In some embodiments, the waistband includes the waistband outer layer and the waistband outer layer extends down below a lower edge of the elastic tape. In some embodiments, a lower edge of the waistband outer layer is inserted between and attached to the two layers of the elastic tape or is inserted into and attached to the Y-shaped bottom edge of the elastic tape.

In some embodiments, in the waistband seam non-pocket portion, the shell upper edge non-pocket portion is inserted between the two layers of the elastic tape or in the Y-shaped bottom edge of the elastic tape, and the shell upper edge non-pocket portion is inserted between and attached to the two layers of the elastic tape, or is inserted between and attached to the Y-shaped bottom edge of the elastic tape.

In some embodiments, in the waistband seam pocket portion and an edge of the front pocket panel or an edge of the back pocket panel is inserted between and attached to the two layers of the elastic tape, or is inserted into and attached to the Y-shaped bottom edge of the elastic tape.

In some embodiments, the pocket further comprises a closure system, and an upper edge of a closure system is inserted between and attached to the two layers of the elastic tape, or is inserted into and attached to the Y-shaped bottom edge of the elastic tape in the waistband seam pocket portion. In some embodiments, a lower edge of the closure system is attached to an edge of the front pocket panel and to the shell upper edge pocket portion opposite the upper edge of the closure system. In some embodiments, the closure system is a two-sided closure system. In some embodiments, the two-sided closure system comprises a zipper, a hook-and-loop closure, or a snap.

In some embodiments, the pocket is in a front pelvic area of the lower body garment configured to cover at least a portion of a front pelvic area of a wearer, or is in a lower back area of the lower body garment configured to cover at least a portion of a lower back area of a wearer. In some embodiments, the garment includes two pockets, and the two pockets are both in the front pelvic area, or the two pockets are both in the lower back area, or a first of the two pockets is in the front pelvic area, and a second of the two pockets is in the lower back area.

In some embodiments, the shell upper edge pocket portion is not gathered along the waistband seam; optionally wherein the shell upper edge non-pocket portion is not gathered along the waistband seam. In some embodiments, the waistband lower edge pocket portion and the waistband lower edge non-pocket portion are not gathered along the waistband seam.

In some embodiments, the shell upper edge pocket portion is gathered along the waistband seam. In some embodiments, the shell upper edge non-pocket portion is gathered along the waistband seam. In some embodiments, the waistband lower edge pocket portion and the waistband lower edge non-pocket portion are not gathered along the waistband seam.

In some embodiments, the shell upper edge pocket portion is not gathered along the waistband seam. In some embodiments, the shell upper edge non-pocket portion is not gathered along the waistband seam. In some embodiments, the waistband lower edge pocket portion and the waistband lower edge non-pocket portion are gathered along the waistband seam.

In some embodiments, the shell upper edge pocket portion is gathered along the waistband seam. In some embodiments, the shell upper edge non-pocket portion is gathered along the waistband seam. In some embodiments, the waistband lower edge pocket portion and the waistband lower edge non-pocket portion are gathered along the waistband seam.

In some embodiments, the pocket bag is positioned below the waistband seam.

In some embodiments, the liner includes a liner waistband attached to a liner upper edge, and an upper edge of the liner waistband is adjacent the waistband upper edge.

In some embodiments, the liner includes a liner upper edge, and the liner upper edge is adjacent to the waistband upper edge.

In some embodiments, the liner includes a liner upper edge, the liner upper edge is adjacent the waistband lower edge, and the liner upper edge comprises a liner upper edge pocket portion and a liner upper edge non-pocket portion. In some embodiments, the waistband includes the two layers of an elastic tape, and the liner upper edge is inserted between and attached to the two layers of the elastic tape.

In some embodiments, the lower body garment is one or more of a short, pant, trouser, legging, tight, skirt, or skort; optionally wherein the lower body garment is the pant, trouser, legging or tight, and the pant, trouser, legging or tight is a cropped pant, trouser, legging or tight.

According to an aspect, there is provided a lower body garment including a waistband configured to be positioned around a waist of a wearer, a liner defining an innermost surface of the lower body garment, a shell defining an outermost surface of the lower body garment and covering at least a portion of the liner below the waistband lower edge, and a pocket configured to contain contents in the lower body garment. The waistband including a waistband outer layer defining an outermost surface of the waistband, a waistband upper edge, and a waistband lower edge. The waistband upper edge defines a waist opening of the lower body garment. The waistband outer layer wraps over the waistband upper edge and forms a drawcord channel along an interior perimeter of the waistband. The waistband lower edge includes a waistband lower edge pocket portion and a waistband lower edge non-pocket portion. The liner is configured to cover a lower torso area below a waist area of a wearer. The liner includes a liner pocket portion. The liner includes a first elastic textile having a stretch axis aligned with the waist opening. The shell includes a shell upper edge. The shell upper edge includes a shell upper edge pocket portion and a shell upper edge non-pocket portion. The pocket includes a pocket bag that includes a back pocket panel formed from the liner pocket portion, a front pocket panel opposite the back pocket panel, a pocket opening along an edge of the front pocket panel and proximate to the shell upper edge pocket portion, and a closed pocket perimeter attaching the front pocket panel and the back pocket panel to each other and defining closed edges of the pocket bag. The pocket bag is configured to contain the contents in an area between the front pocket panel and the back pocket panel within the closed pocket perimeter. The lower body garment includes a waistband seam. The waistband seam includes a waistband seam pocket portion and a waistband seam non-pocket portion. The waistband seam non-pocket portion connects the waistband lower edge non-pocket portion with the shell upper edge non-pocket portion. The waistband seam pocket portion connects the waistband lower edge pocket portion with the liner upper edge pocket portion, and includes the pocket bag extending along the liner from the waistband seam pocket portion to below the waistband seam pocket portion. The front pocket panel is positioned between an inward-facing surface of the back pocket panel and an opposing inward-facing surface of the shell. An upper edge of the front pocket panel is attached to the shell upper edge pocket portion, the pocket opening is positioned along the waistband seam pocket portion, and the pocket opening is configured to provide access to the pocket from the outermost surface of the shell.

According to an aspect, there is provided a method of manufacturing a lower body garment. The method includes affixing a waistband, a liner, and a shell to each other. The waistband, the liner, and the shell are the waistband, the liner, and the shell described above.

According to an aspect, there is provided a lower body garment manufactured according to the method described above.

Many further features and combinations thereof concerning the present improvements will appear to those skilled in the art following a reading of the instant disclosure.

DESCRIPTION OF THE DRAWINGS

In the figures, embodiments are illustrated by way of example. It is to be expressly understood that the description and figures are only for the purpose of illustration and as an aid to understanding.

DETAILED DESCRIPTION

Figure 1B:
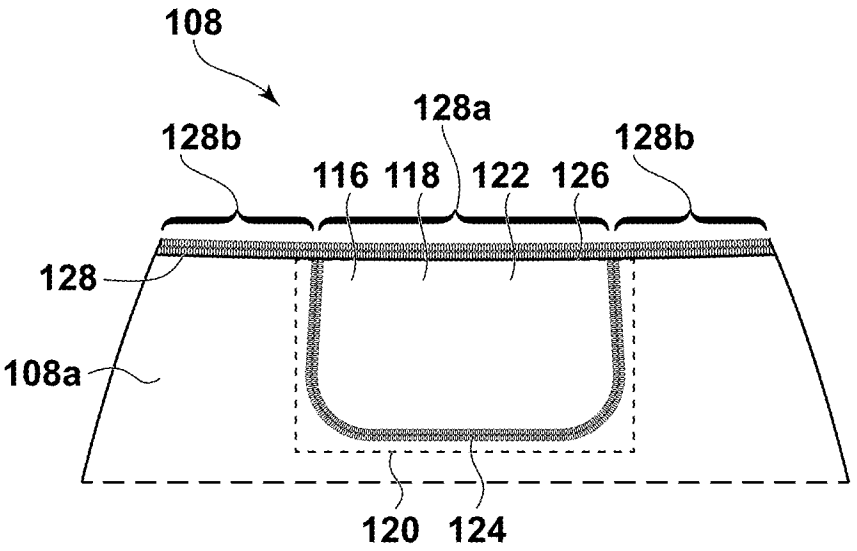
FIG. 1B shows a rear view of a liner of the garment of FIG. 1A, according to some embodiments.

Reference will now be made in detail to embodiments of the invention, examples of which are illustrated in the accompanying drawings. While the invention is described in conjunction with these embodiments, it will be understood that the descriptions herein are not intended to limit the invention to these embodiments. On the contrary, the invention is intended to cover alternatives, modifications, and equivalents that may be included within the spirit and scope of the invention as defined by the appended claims. Detailed description of components that are well known in the art may be omitted if that detailed description would confuse or obscure the description of the embodiments of the present invention.

Directional terms such as "top", "bottom", "front", "back", "rear', "upper", "lower", "outer" and "inner" are used in the following description for the purpose of providing relative reference only and are not intended to suggest any limitations on how any article or garment is to be positioned during use, or to be mounted in an assembly or relative to an environment. The use of the word "a" or "an" when used herein in conjunction with the term "comprising" may mean "one", but it is also consistent with the meaning of "one or more", "at least one" and "one or more than one". Any element expressed in the singular form also encompasses its plural form. Any element expressed in the plural form also encompasses its singular form. The term "plurality" as used herein means more than one, for example, two or more, three or more, four or more, and the like.

The term "substantially" as used herein may be applied to modify any quantitative representation which could permissibly vary without resulting in a change in the basic function to which it is related.

The present disclosure relates to lower body garments, such as shorts, having structured pockets. The lower body garments described herein comprise a liner and a shell. In a preferred embodiment, pockets are constructed on the liner with a pocket opening which can be accessed through the shell. The pockets can be preferably positioned on the back and/or front of the garment. The liner and the shell may be in form a short, pant, trouser, legging, cropped pant, skirt, or skort.

Clause 1. A lower body garment 100 comprising: a waistband 102 configured to be positioned around a waist of a wearer, wherein the waistband 102 comprises a waistband upper edge 104 and a waistband lower edge 106, the waistband upper edge 104 defines a waist opening of the lower body garment 100, and the waistband lower edge 106 comprises a waistband lower edge pocket portion 106*a* and a waistband lower edge non-pocket portion 106*b*; a liner 108 defining an innermost surface of the lower body garment 100, wherein the liner 108 is configured to cover a lower torso area below a waist area of a wearer, wherein the liner 108 comprises a liner pocket portion 121; a shell 112 defining an outermost surface of the lower body garment 100 and covering at least a portion of the liner 108 below the waistband lower edge 106, the shell 112 comprising a shell upper edge 114, and the shell upper edge 114 comprising a shell upper edge pocket portion 114*a* and a shell upper edge non-pocket portion 114*b*; a pocket 116 configured to contain contents in the lower body garment 100, wherein the pocket 116 comprises a pocket bag 118 that includes a back pocket panel 120 formed from the liner pocket portion 121 or attached to the liner pocket portion 121, a front pocket panel 122 opposite the back pocket panel 120, a pocket opening 126 along an edge of the front pocket panel 122 and proximate to the shell upper edge pocket portion 114*a*, and a closed pocket perimeter 124 attaching the front pocket panel 122 and the back pocket panel 120 to each other and defining closed edges of the pocket bag 118, wherein the pocket bag 118 is configured to contain the contents in an area between the front pocket panel 122 and the back pocket panel 120 within the closed pocket perimeter 124; wherein the lower body garment 100 comprises a waistband seam 128, the waistband seam 128 includes a waistband seam pocket portion 128*a* and a waistband seam non-pocket portion 128*b*, the waistband seam non-pocket portion 128*b* connects the waistband lower edge non-pocket portion 106*b* with the shell upper edge non-pocket portion 110*b*, and the waistband seam pocket portion 128*a* connects the waistband lower edge pocket portion 106*a* with the back pocket panel 120; wherein the front pocket panel 122 is positioned between an inward-facing surface of the back pocket panel 120 and an opposing inward-facing surface of the shell 112; and wherein an upper edge of the front pocket panel 122 is attached to the shell upper edge pocket portion 114*a*, the pocket opening 126 is positioned along the waistband seam pocket portion 128*a*, and the pocket opening 126 is configured to provide access to the pocket bag 118 from the outermost surface of the shell 112.

Clause 2. The lower body garment 100 of Clause 1, wherein the liner 108 comprises a first elastic textile having a stretch axis aligned with the waist opening; optionally wherein the liner 108 includes a first pair of leg portions 109*a* and 109*b*, each of the first pair of leg portions 109*a* and 109*b* includes a bottom opening, and the each of the first pair of leg portions 109*a* and 109*b* is configured to be positioned around a leg of a wearer during wear of the garment 100.

Clause 3. The lower body garment 100 of Clause 1 or 2, wherein the liner 108 comprises a liner upper portion 108*a* and a liner body portion 108*b* extending below the liner upper portion 108*a*; optionally wherein the liner upper portion 108*a* extends beyond the closed pocket perimeter 124 at least to left and right side seams of the lower body garment 100 and is attached to left and right side seams of the lower body garment 100; optionally wherein the liner upper portion 108*a* extends at least partially around a waistband perimeter of the lower body garment 100 and is configured to at least partially encircle a waist area of a wearer; optionally wherein the liner upper portion 108*a* is configured to fully encircle a waist area of a wearer; optionally wherein the liner body portion 108*b* includes a first pair of leg portions 109*a* and 109*b*.

Clause 4. The lower body garment 100 of Clause 3, wherein the shell 112 comprises a shell upper portion 112*a* and a shell body portion 112*b* extending below the shell upper portion 112*a*, the shell upper portion 112*a* at least partially covers the liner upper portion 108*a* and includes the shell upper edge 114; optionally wherein the shell body portion 112*b* includes a second pair of leg portions 113*a* and 113*b*, each of the second pair of leg portions 113*a* and 113*b* includes a bottom opening, and the each of the second pair of leg portions 113*a* and 113*b* is configured to be positioned around a leg of a wearer during wear of the garment 100.

Clause 5. The lower body garment 100 of any one of Clauses 1 to 4, wherein the back pocket panel 120 is formed from the liner pocket portion 121, the liner 108 comprises a first elastic textile having an axis of stretch aligned with the waist opening, and the front pocket panel 122 comprises a second elastic textile having an axis of stretch aligned with the waist opening; optionally wherein a level of stretch of the first elastic textile and of the second elastic fabric along the axis are within 20 percent of each other.

Clause 6. The lower body garment 100 of any one of Clauses 1 to 4, wherein the back pocket panel 120 is attached to the liner 108, the liner 108 comprises a first elastic textile having an axis of stretch aligned with the waist opening, and the front pocket panel 122 comprises a second elastic textile having an axis of stretch aligned with the waist opening; optionally wherein a level of stretch of the first elastic textile and of the second elastic textile along the axis are within 20 percent of each other.

Clause 7. The lower body garment 100 of any one of Clauses 1 to 6, wherein the pocket opening 126 comprises a closure movable between an open position and a closed position; optionally wherein the closure is a two-sided closure, and a first side of the closure is attached to the waistband lower edge pocket portion 106*a* and a second side of the closure is attached to the shell upper edge pocket portion 114*a*; optionally wherein the two-sided closure is a zipper 142, a hook-and-loop closure, a snap.

Clause 8. The lower body garment 100 of any one of Clauses 1 to 7, wherein the waistband 102 comprises a waistband outer layer 130 defining an outermost surface of the waistband 102 and the waistband outer layer 130 wraps over the waistband upper edge 104.

Clause 9. The lower body garment 100 of Clause 8, wherein the waistband outer layer 130 forms a drawcord channel 133, the waistband 102 includes a drawcord 134 in the drawcord channel 133, and the drawcord channel 133 includes a drawcord opening 135 configured to provide access to the drawcord 134; optionally wherein the drawcord channel 133 formed by the waistband outer layer 130 is along an exterior perimeter of the waistband 102 or is along an interior perimeter of the waistband 102; optionally wherein the drawcord channel 133 is along the interior perimeter of the waistband 102 and the drawcord opening 135 is on an innermost surface of the waistband 102.

Clause 10. The lower body garment 100 of any one of Clauses 1 to 8, wherein the waistband 102 comprises a waistband inner layer 132 defining an innermost surface of the waistband 102; optionally wherein the waistband inner layer 132 forms a drawcord channel 133 along an interior perimeter of the waistband 102, the waistband 102 includes a drawcord 134 in the drawcord channel 133, and the drawcord channel 134 includes a drawcord opening 135 configured to provide access to the drawcord 134; optionally wherein the drawcord opening 135 is on the innermost surface of the waistband 102.

Clause 11. The lower body garment 100 of any one of Clauses 1 to 10, wherein the waistband 102 comprises a length of elastic tape 136 extending circumferentially around the waist opening; optionally wherein the elastic tape 136 is positioned behind a waistband outer layer 130, or is positioned in front of a waistband inner layer 132, or is positioned between a waistband outer layer 130 and a waistband inner layer 132; optionally wherein the length of elastic tape 136 comprises two layers forming an open passage 136*a* between the two layers positioned along a lower edge of the elastic tape 136; optionally wherein the length of elastic tape 136 is a length of elastic tape having a Y-shaped bottom edge.

Clause 12. The lower body garment 100 of Clause 11, wherein the waistband 102 comprises the waistband outer layer 130, the waistband outer layer 130 extends down below a lower edge of the elastic tape 136; optionally wherein a lower edge of the waistband outer layer 130 is inserted between and attached to the two layers of the elastic tape 136 or is inserted into and attached to the Y-shaped bottom edge of the elastic tape 136.

Clause 13. The lower body garment of Clauses 11 or 12, wherein, in the waistband seam non-pocket portion 128*b*, the shell upper edge non-pocket portion 114*b* is inserted between the two layers of the elastic tape 136 or in the Y-shaped bottom edge of the elastic tape, and the shell upper edge non-pocket portion 114*b* is inserted between and attached to the two layers of the elastic tape 136, or is inserted between and attached to the Y-shaped bottom edge of the elastic tape 136.

Clause 14. The lower body garment 100 of any one of Clauses 11 to 13, wherein, in the waistband seam pocket portion 128*a* and an edge of the front pocket panel 122 or an edge of the back pocket panel 120 is inserted between and attached to the two layers of the elastic tape 136, or is inserted into and attached to the Y-shaped bottom edge of the elastic tape 136.

Clause 15. The lower body garment of any one of Clauses 11 to 14, wherein, the pocket 116 further comprises a closure system, and an upper edge of a closure system is inserted between and attached to the two layers of the elastic tape 136, or is inserted into and attached to the Y-shaped bottom edge of the elastic tape 136 in the waistband seam pocket portion 128*a*; optionally wherein a lower edge of the closure system is attached to an edge of the front pocket panel 122 and to the shell upper edge pocket portion 114*a* opposite the upper edge of the closure system; optionally wherein the closure system is a two-sided closure system; optionally wherein the two-sided closure system comprises a zipper 142, a hook-and-loop closure, or a snap.

Clause 16. The lower body garment 100 of any one of Clauses 1 to 15, wherein the pocket 116 is in a front pelvic area of the lower body garment 100 configured to cover at least a portion of a front pelvic area of a wearer, or is in a lower back area of the lower body garment 100 configured to cover at least a portion of a lower back area of a wearer; optionally wherein the garment 100 includes two pockets, and the two pockets 116 are both in the front pelvic area, or the two pockets 116 are both in the lower back area, or a first of the two pockets 116 is in the front pelvic area, and a second of the two pockets 116 is in the lower back area.

Clause 17. The lower body garment 100 of any one of Clauses 1 to 16, wherein the shell upper edge pocket portion 114*a* is not gathered along the waistband seam 128; optionally wherein the shell upper edge non-pocket portion 114*b* is not gathered along the waistband seam 128; optionally wherein the waistband lower edge pocket portion 106*a* and the waistband lower edge non-pocket portion 106*b* are not gathered along the waistband seam 128.

Clause 18. The lower body garment 100 of any one of Clauses 1 to 16, wherein the shell upper edge pocket portion 114*a* is gathered along the waistband seam 128; optionally wherein the shell upper edge non-pocket portion 114*b* is gathered along the waistband seam 128; optionally wherein the waistband lower edge pocket portion 106*a* and the waistband lower edge non-pocket portion 106*b* are not gathered along the waistband seam 128.

Clause 19. The lower body garment 100 of any one of Clauses 1 to 16, wherein the shell upper edge pocket portion 114*a* is not gathered along the waistband seam 128; optionally wherein the shell upper edge non-pocket portion 114*b* is not gathered along the waistband seam 128; optionally wherein the waistband lower edge pocket portion 106*a* and the waistband lower edge non-pocket portion 106*b* are gathered along the waistband seam 128.

Clause 20. The lower body garment of any one of Clauses 1 to 16, wherein the shell upper edge pocket portion 114*a* is gathered along the waistband seam 128; optionally wherein the shell upper edge non-pocket portion 114*b* is gathered along the waistband seam 128; optionally wherein the waistband lower edge pocket portion 106*a* and the waistband lower edge non-pocket portion 106*b* are gathered along the waistband seam 128.

Clause 21. The lower body garment 100 of any one of Clauses 1 to 20, wherein the pocket bag 118 is positioned below the waistband seam 128.

Clause 22. The lower body garment 100 of any one of Clauses 1 to 21, wherein the liner 108 includes a liner waistband attached to a liner upper edge 110, and an upper edge of the liner waistband is adjacent the waistband upper edge 104.

Clause 23. The lower body garment 100 of any one of Clauses 1 to 21, wherein the liner 108 includes a liner upper edge 110, and the liner upper edge 110 is adjacent to the waistband upper edge 104.

Clause 24. The lower body garment 100 of any one of Clauses 1 to 21, wherein the liner 108 includes a liner upper edge 110, the liner upper edge 110 is adjacent the waistband lower edge 106, and the liner upper edge 110 comprises a liner upper edge pocket portion 110*a* and a liner upper edge non-pocket portion 110*b*; optionally wherein the waistband 102 includes the two layers of an elastic tape 136, and the liner upper edge 110 is inserted between and attached to the two layers of the elastic tape 136.

Clause 25. The lower body garment 100 of any one of Clauses 1 to 24, wherein the lower body garment 100 is one or more of a short, pant, trouser, legging, tight, skirt, or skort; optionally wherein the lower body garment is the pant, trouser, legging or tight, and the pant, trouser, legging or tight is a cropped pant, trouser, legging or tight.

Clause 26. A lower body garment 100 comprising: a waistband 102 configured to be positioned around a waist of a wearer, wherein the waistband 102 comprises a waistband outer layer 130 defining an outermost surface of the waistband 102, a waistband upper edge 104, and a waistband lower edge 106, the waistband upper edge 104 defines a waist opening of the lower body garment 100, the waistband outer layer 130 wraps over the waistband upper edge 104 and forms a drawcord channel 133 along an interior perimeter of the waistband 102, and the waistband lower edge 106 comprises a waistband lower edge pocket portion 106*a* and a waistband lower edge non-pocket portion 106*b*; a liner 108 defining an innermost surface of the lower body garment 100, wherein the liner 108 is configured to cover a lower torso area below a waist area of a wearer, wherein the liner 108 comprises a liner pocket portion 121, wherein the liner 108 comprises a first elastic textile having a stretch axis aligned with the waist opening; a shell 112 defining an outermost surface of the lower body garment 100 and covering at least a portion of the liner 108 below the waistband lower edge 106, the shell 112 comprising a shell upper edge 114, and the shell upper edge 114 comprising a shell upper edge pocket portion 114*a* and a shell upper edge non-pocket portion 114*b*; a pocket 116 configured to contain contents in the lower body garment 100, wherein the pocket 116 comprises a pocket bag 118 that includes a back pocket panel 120 formed from the pocket portion 121 of the liner 108, a front pocket panel 122 opposite the back pocket panel 120, a pocket opening 126 along an edge of the front pocket panel 122 and proximate to the shell upper edge pocket portion 114*a*, and a closed pocket perimeter 124 attaching the front pocket panel 122 and the back pocket panel 120 to each other and defining closed edges of the pocket bag 118, wherein the pocket bag 118 is configured to contain the contents in an area between the front pocket panel 122 and the back pocket panel 120 within the closed pocket perimeter 124; wherein the lower body garment 100 comprises a waistband seam 128, the waistband seam 128 includes a waistband seam pocket portion 128*a* and a waistband seam non-pocket portion 128*b*, the waistband seam non-pocket portion 128*b* connects the waistband lower edge non-pocket portion 106*b* with the shell upper edge non-pocket portion 114*b*, and the waistband seam pocket portion 128*a* connects the waistband lower edge pocket portion 106*a* with the liner upper edge pocket portion 110*a*, and includes the pocket bag 118 extending along the liner 108 from the waistband seam pocket portion 128*a* to below the waistband seam pocket portion 128*a*; wherein the front pocket panel 122 is positioned between an inward-facing surface of the back pocket panel 120 and an opposing inward-facing surface of the shell 112; and wherein an upper edge of the front pocket panel 122 is attached to the shell upper edge pocket portion 114*a*, the pocket opening 126 is positioned along the waistband seam pocket portion 128*a*, and the pocket opening 126 is configured to provide access to the pocket 116 from the outermost surface of the shell 112.

Clause 27. A method 700 of manufacturing a lower body garment 100, the method 700 comprising: affixing a waistband 102, a liner 108, and a shell 112 to each other (block 702), wherein the waistband 102, the liner 108, and the shell 112 are the waistband 102, the liner 108, and the shell 112 according to any one of Clauses 1 to 26.

Clause 28. A lower body garment 100 manufactured according to the method 700 of Clause 27.

Figure 1A:
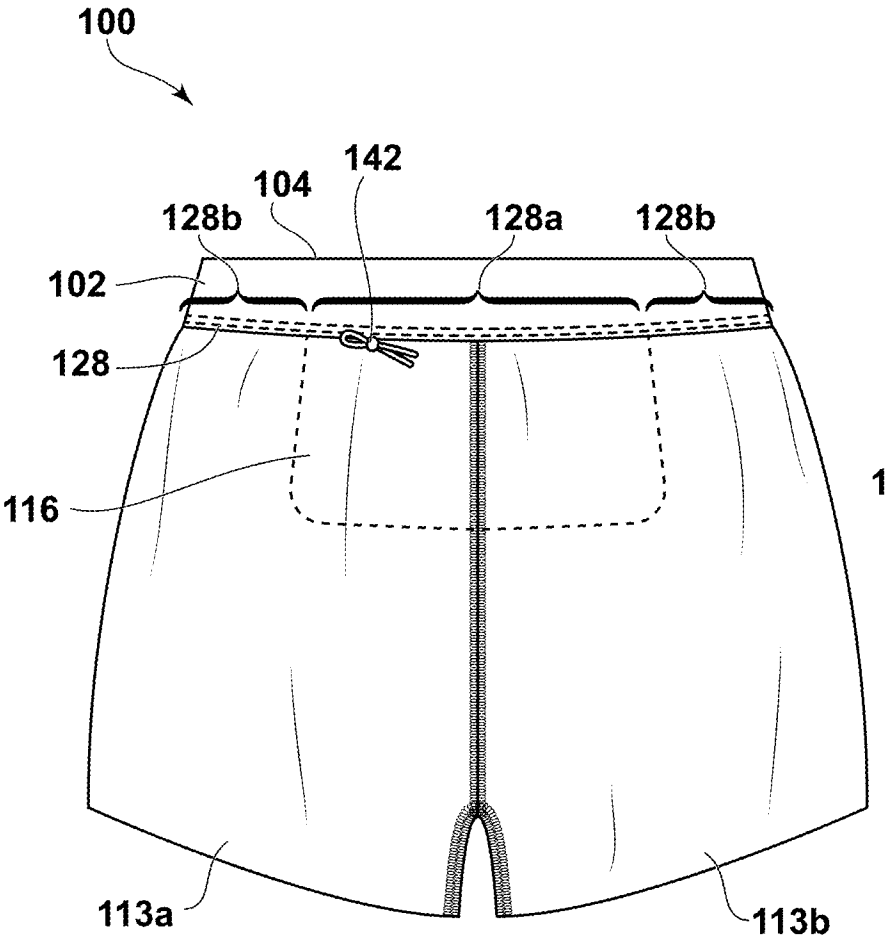
FIG. 1A shows a rear view of a garment, according to some embodiments.

FIG. 1A shows a rear view of a garment 100, according to some embodiments. FIG. 1B shows a rear view of a liner 108 consisting of a liner upper portion 108*a* of the garment 100, according to some embodiments.

The garment 100 described herein can generally be a lower body garment such as a short, pant, trouser, legging, cropped pant, skirt, or skort. The garment 100 can include a waistband 102, a liner 108, and a shell 112 (shown in FIG. 1A and omitted in 1B). The waistband 102 may be configured to encircle a waist of a wearer and support the garment 100 when worn (e.g., help hold the garment 100 up and/or in position). The liner 108 may be configured fit closely to the wearer's body. The liner 108 may consist of or comprise a liner upper portion 108*a* and an optional liner body portion 108*b* (only the liner upper portion 108*a* is present in the embodiment of FIG. 1A and FIG. 1B, and is only visible in FIG. 1B; a liner 108 with a liner body portion 108*b* is pictured in FIG. 2B, FIG. 5A, and FIG. 5B described below). The liner 108 may provide support to the wearer during physical activity (e.g., to help support the wearer's body). The liner 108 may support the rest of the garment 100 (e.g., to help the rest of the garment 100 remain in position during use). The liner 108 may also provide other beneficial properties to the wearer such as moisture wicking properties. The shell 112 may be configured to fit over at least a portion of the liner 108. The shell 112 may be of a looser fit and may generally provide the wearer with more coverage for their pelvic region (e.g., for modesty). The shell 112 may also be configured to provide other beneficial properties to the wearer such as insulation (e.g., wind resistance). The combination of the liner 108 and the shell 112 can provide the wearer with the advantages of a snug fitting garment with the liner 108 (e.g., support and possibly moisture wicking) and the advantages of a looser fitting garment with the shell 112 (e.g., modesty and possibly insulation).

It may be challenging to configure garments 100 with liners 108 and shells 112 with adequate storage. For example, a pocket bag in the loosely fit shell 112 may bounce during movement (e.g., the contents of the pocket may bounce around or against the wearer during activities such as running) or may uncomfortably reposition (e.g., the contents may move in the pocket during, for example, yoga poses). However, a pocket bag in the liner 108 may not be accessible to the user without going under the shell 112 (which may obviate the modesty provided by the shell 112). Accordingly, providing garments 100 with pockets that will securely, comfortably, and accessibly hold contents is beneficial.

The garment 100 described herein includes a pocket 116 (illustrated as being in the a rear region of the garment 100, but may equally be positioned elsewhere along the waistband seam 128). The pocket 116 can include a pocket bag 118. The pocket bag 118 can include a back pocket panel 120 and a front pocket panel 122. The back pocket panel 120 may be made up of a back pocket portion 121 of the liner 108 or may be attached to the liner 108. The back pocket panel 120 may be attached to the front pocket panel 122. For example, a closed pocket perimeter 124 may define closed edges of the pocket bag 118. The pocket bag 118 may be open along a pocket opening 126. The pocket opening 126 may be positioned along an edge of the front pocket panel 122 and proximate to the shell upper edge pocket portion 110*a*. The pocket bag 118 can be configured to contain its contents in the area between the front pocket panel 122 and the back pocket panel 120 within the closed pocket perimeter 124.

The pocket 116 can be positioned along a waistband seam 128 (generally where the waistband lower edge 106 meets the shell upper edge 114). In some embodiments, the liner upper edge 110 may also meet the waistband lower edge 106 at the waistband seam 128. In some embodiments, the liner 108 may extend above the waistband lower edge 106. In some embodiments, the liner 108 may have its own waistband seam. The pocket 116 may include a pocket opening 126 that generally follows or is contained within the waistband seam 128 and a closed pocket perimeter 124 to define a pocket bag 118 of the pocket 116. The waistband seam 128 may include a waistband seam pocket portion 128*a* and a waistband seam non-pocket portion 128*b*. The waistband seam non-pocket portion 128*b* may generally attach the components (e.g., the waistband seam non-pocket portion 128*b* may attach the waistband lower edge non-pocket portion 106*b* to a shell upper edge non-pocket portion 114*b*) and the waistband seam pocket portion 128*a* may leave a pocket opening 126 (e.g., the waistband seam pocket portion 128*a* may attach to a waistband lower edge pocket portion 106*a* to a liner upper edge pocket portion 110*a* leaving a shell upper edge pocket portion 114*a* open to access the pocket 116).

Figure 2A:
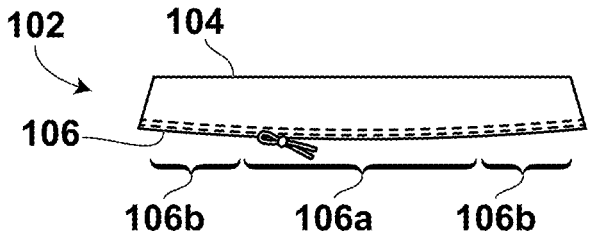
FIG. 2A, FIG. 2B, and FIG. 2C show a rear view of the waistband, the liner, and the shell that make up the garment of FIG. 1A, according to some embodiments.
Figure 2B:
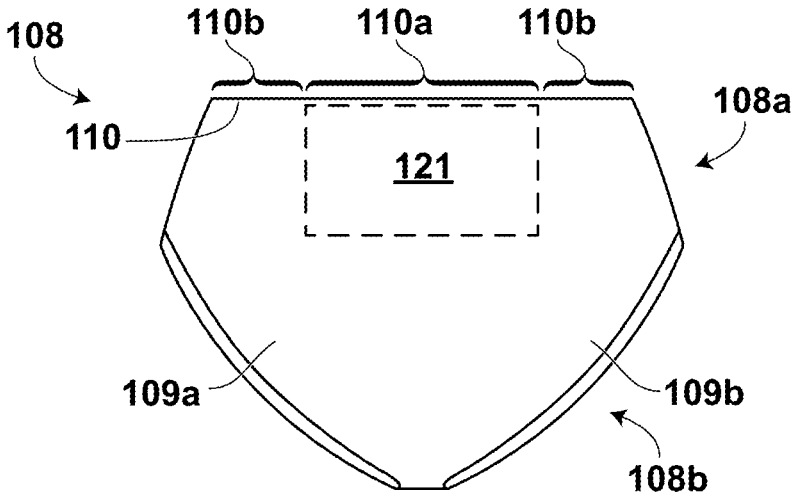
Figure 2C:
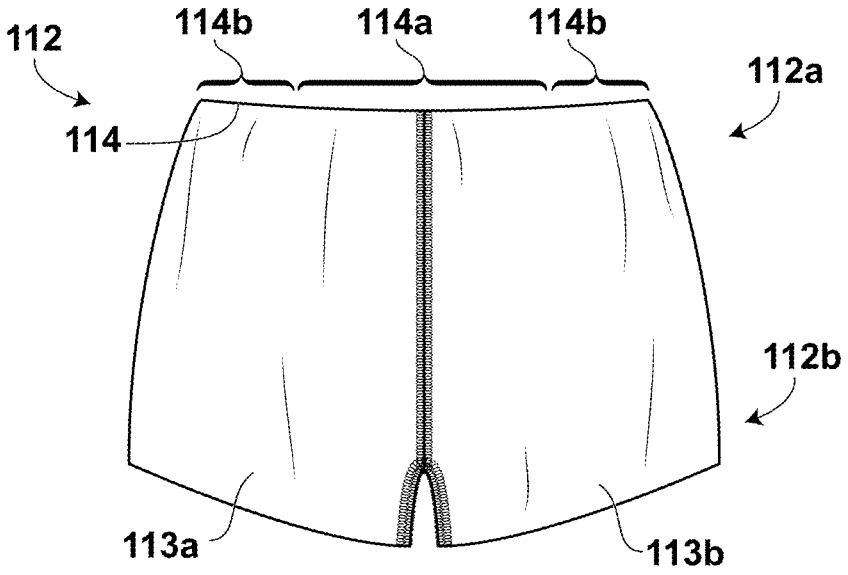

FIG. 2A, FIG. 2B, and FIG. 2C show a rear view of the waistband 102, the liner 108, and the shell 112 that make up the garment 100, according to some embodiments.

The waistband 102 (FIG. 2A) includes a waistband upper edge 104 which may define a waist opening of the garment 100. The waistband 102 includes a waistband lower edge 106 that is configured to attach to a shell upper edge 114, and optionally to a liner upper edge 110 as shown in FIG. 2B. The waistband lower edge 106 may be divided into the a waistband lower edge pocket portion 106*a* and a waistband lower edge non-pocket portion 106*b*. The waistband lower edge 106 may generally be connected to other components of the garment 100 at the waistband seam 128 in the final garment 100.

The liner 108 (FIG. 2B) includes a liner upper edge 110 proximate the waistband lower edge 106. The liner 108 can include a liner upper portion 108*a* and a liner body portion 108*b*. In some embodiments including the embodiment of FIG. 2B, the liner upper edge 110 may be connected to the waistband 102 using the waistband seam 128 in the final garment 100. Alternatively, an edge of the liner 108 may attach to the waistband 102 above the waistband seam 128, such as along the waistband upper edge 104 (not illustrated). The liner upper edge 110 may be divided into a liner upper edge pocket portion 110*a* and a liner upper edge non-pocket portion 110*b*. In some embodiments, the liner 108 may include a back pocket portion 121. The back pocket portion 121 may be used as the back pocket panel 120 of the pocket 116 in the final garment 100 without adding any additional components to the back pocket portion 121. Alternatively, a separate component forming the back pocket panel 120 may be attached to the back pocket portion 121 (not illustrated). The liner 108 (e.g., the liner upper portion 108*a*) may encircle at least a portion of a waist of the wearer. The liner 108 may optionally include a liner body portion 108*b* extending below the liner upper portion 108*a*. The liner body portion 108*b* can optionally include a pair of leg portions (leg portions 113*a* and 113*b*) each with a bottom opening and configured to be worn around the leg of the wearer. The liner 108 can include an elastic textile. The elastic textile may have a stretch axis that is aligned with the waist opening of the garment 100.

The shell 112 (FIG. 2C) includes a shell upper edge 114 which may generally be connected to the waistband 102 using the waistband seam 128 in the final garment 100. The shell upper edge 114 may be divided into a shell upper edge pocket portion 114*a* and a shell upper edge non-pocket portion 114*b*. The shell 112 may also include a shell upper portion 112*a* which may generally include the shell upper edge 114. The shell upper portion 112*a* may be configured to generally cover at least a portion of a waist area of the wearer below the waistband. The shell 112 may optionally include a shell body portion 112*b* extending below the shell upper portion 112*a*. The shell body portion 112*b* can optionally include a pair of leg portions (leg portions 109*a* and 109*b*) each with a bottom opening and configured to be worn around the leg of the wearer. The shell upper portion 112*a* may generally be configured to cover at least the liner upper portion 108*a*. The shell body portion 112*b* may generally be configured to cover the liner body portion 108*b* in embodiments including the optional liner body portion 108*b*.

As illustrated in FIG. 2B and FIG. 2C, the leg openings in the leg portions 109*a* and 109*b* of the liner 108 may be generally flush with any crotch seam (e.g., there is little to no inseam), while the leg portions 113*a* and 113*b* of the shell 112 may extend past the leg portions 109*a* and 109*b* of the liner 108 (e.g., there is a longer inseam of the leg portions 113*a* and 113*b* of the shell 112 than the leg portions 109*a* and 109*b* of the liner 108). This may be useful to provide support and other beneficial properties in relevant regions (e.g., moisture wicking) without excessively restricting the wearer or to provide the wearer with more breathability (e.g., in their upper legs/thighs).

In some embodiments, the inseam of the leg portions 109*a* and 109*b* of the liner body portion 108*b* may extend past the inseam of the leg portions 113*a* and 113*b* of the shell body portion 112*b* (not pictured). This may expose a portion of the liner body portion 108*b* below the shell body portion 112*b*. This may provide more support and other beneficial properties to a greater region of the wearer (e.g., along the upper leg/thigh) while providing the modesty of the shell 112 where needed (e.g., the pelvic region). This may additionally provide visual interest by exposing the patterning and design of the liner body portion 108*b* below the patterning and design of the shell body portion 112*b*.

In some embodiments, the shell upper edge 114 may be gathered along the waistband seam 128. In some embodiments, the shell upper edge 114 may not be gathered along the waistband seam 128. In some embodiments, the shell upper edge 114 may include gathered and not gathered regions positioned along the waistband seam 128. In some embodiments, the shell upper edge 114 may be gathered along a waistband seam pocket portion 128*a* and not gathered along the waistband seam non-pocket portion 128*b* or vice versa.

Referring back to FIG. 1A and FIG. 1B, the final garment 100 may be constructed by attaching the waistband 102 with the liner 108 (e.g., liner upper portion 108*a*) and the shell 112. The waistband 102 may be attached with a waistband seam 128. The waistband seam 128 may include a waistband seam pocket portion 128*a* and a waistband seam non-pocket portion 128*b*. The waistband seam 128 may connect differently to components based on whether in the waistband seam pocket portion 128*a* or the waistband seam non-pocket portion 128*b*. There may also be more than one waistband seam pocket portion 128*a* (e.g., if there is more than one pocket 116) which may each be configured differently or similarly and more than one non-pocket portion of the waistband seam 128*b* (e.g., between a plurality of pockets 116). Furthermore, the waistband seam 128 may vary along its circumference depending on the needs in the final garment 100 (e.g., the side portions of the waistband seam 128 may be configured differently than the front and/or back of the waistband seam 128).

Figure 3B:
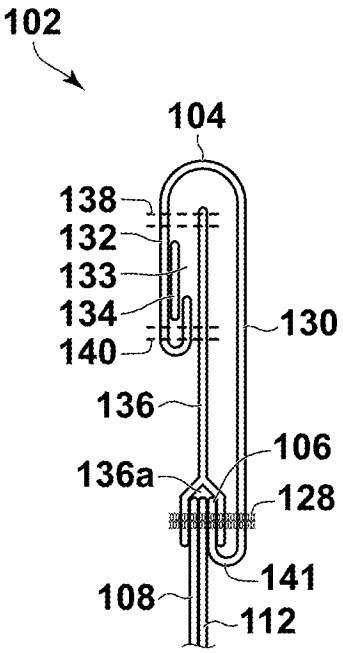
FIG. 3B shows a cross-sectional view of a waistband seam non-pocket portion of the garment of FIG. 1A, according to some embodiments.

The waistband seam non-pocket portion 128*b* may attach the waistband lower edge non-pocket portion 106*b* to the shell upper edge non-pocket portion 114*b* (as seen in detail in FIG. 3B). Alternatively or additionally, the waistband seam non-pocket portion 128*b* may attach the waistband lower edge non-pocket portion 106*b* to a liner upper edge non-pocket portion 110*b*.

Figure 3A:
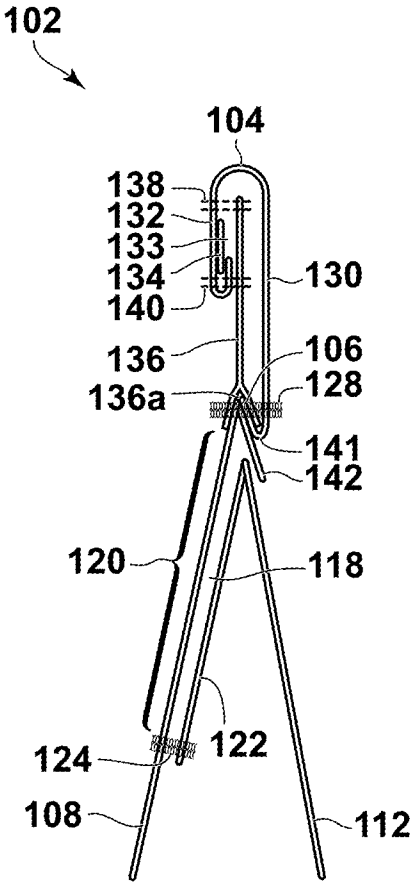
FIG. 3A shows a cross-sectional view of a waistband seam pocket portion of the garment of FIG. 1A, according to some embodiments.

The waistband seam pocket portion 128*a* may attach the waistband lower edge pocket portion 106*a* to the liner upper edge pocket portion 110*a* (as seen in detail in FIG. 3A). Attaching the elements in this way may ensure that the garment is configured to cover a wearer while also allowing access to the pocket by the wearer.

The liner upper edge pocket portion 110*a* may be positioned above a back pocket portion 121 of the liner 108. In some embodiments, the back pocket portion 121 of the liner 108 is used as the back pocket panel 120 of the pocket 116. In other embodiments, the back pocket portion 121 of the liner 108 is attached to a separate back pocket panel 120 of the pocket 116. Either embodiment is configured to hold the pocket 116 to the liner 108 such that the contents of the pocket 116 do not freely shift relative to the wearer during wearer movement.

In some embodiments, the waistband seam pocket portion 128*a* is unattached to the shell upper edge pocket portion 114*a* to provide the pocket opening 126. In some embodiments, the waistband seam pocket portion 128*a* may be indirectly attached to the shell upper edge pocket portion 114*a*, for example, via a closure. The closure may be movable between an open position and a closed position. The closure may be a two-sided closure. One side of the closure may be attached to the waistband lower edge pocket portion 106*a* and the other side of the closure may be attached to the shell upper edge pocket portion 114*a*. In some embodiments, the closure can be a zipper (e.g., zipper 142), a hook-and-loop closure, or a snap. The zipper 142 may be a conventional zipper or a hidden zipper.

In some embodiments, the pocket 116 may be formed on the garment 100 along the waistband seam 128 (e.g., the waistband seam pocket portion 128*a*). The pocket bag 118 of pocket 116 may be formed from a back pocket panel 120 and a front pocket panel 122. The back pocket panel 120 may be formed from a pocket portion 121 of the liner 108 or from a separate panel attached to the liner pocket portion 121. Either configuration can keep the pocket 116 in position during use (e.g., while running). In some embodiments, the back pocket panel 120 (which can be integral with the liner 108) includes an elastic textile with an axis of stretch aligned with the waist opening of the garment 100 and the front pocket panel 122 also includes an elastic textile with an axis of stretch aligned with the waist opening of the garment 100. The elastic textiles making up the back pocket panel 120 and the front pocket panel 122 can have a level of stretch that is within 20% of each other. Alternatively, the level of stretch of the elastic textile of the back pocket panel 120 can be lower that the level of stretch of the elastic textile of the front pocket panel 122 such that the back pocket panel 120 is more rigid and less deformable than the front pocket panel 122. Configuring the pocket panels in this way may prevent articles contained in the pocket bag 118 from easily deforming the back pocket panel 120 and potentially digging into the skin of a wearer, while allowing those articles to more easily deform the front pocket panel 122 without digging into the skin of a wearer.

The pocket 116 includes a pocket bag 118. The pocket bag 118 may be formed by attaching a back pocket panel 120 to a front pocket panel 122 with a closed pocket perimeter 124 to define closed edges of the pocket bag 118. The pocket bag 118 may have a pocket opening 126 along at least a portion of the edge of the front pocket panel 122 and proximate to the shell upper edge pocket portion 110*a*. The pocket bag 118 may be accessible from the pocket opening 126 which can be proximate the waistband seam 128 (e.g., along waistband seam pocket portion 128*a*). The back pocket panel 120 may be (or may be attached to) the pocket portion 121. The upper edge of the back pocket panel 120 (e.g., one side of the pocket opening 126) may be attached to the waistband lower edge pocket portion 106*a* with the waistband seam pocket portion 128*a*. Alternatively, the upper edge of the back pocket panel 120 may extend above or below the waistband seam 128 and attached to the garment above or below the waistband seam 128 (not illustrated). The upper edge of the front pocket panel 122 may be attached to the shell upper edge pocket portion 114*a*. This may beneficially close off any gap between the shell 112 and the pocket bag 118 to ensure that contents are placed through the shell 112 and into the pocket bag 118 rather than through a gap in the garment 100 and dropped to the ground.

The upper edge of the back pocket panel 120 and the upper edge of the front pocket panel 122 or the waistband lower edge 106 and the upper edge of the front pocket panel 122 may be attached with, for example, a closure movable between an open and closed state. As described above, the closure may be, for example, a zipper, a hook-and-loop mechanism, a snap, or a button. In some embodiments, the upper edge of the back pocket panel 120 and the upper edge of the front pocket panel 122 or the waistband lower edge 106 and the upper edge of the front pocket panel 122 may be permanently attached at the periphery of the waistband seam pocket portion 128*a*, (e.g., on either side of the waistband seam pocket portion 128*a*, where the waistband seam pocket portion 128*a* transitions to the waistband seam non-pocket portion 128*b*). This may provide some allowance at the edge of the pocket 116 such that if the edges of the pocket opening 126 become worn, then the allowance is worn rather than a waistband seam non-pocket portion 128*b*. The attachments at the periphery of the waistband seam pocket portion 128*a* may also increase the durability of the attachments between the pocket 116 and the waistband seam 128 and thus between the pocket 116 and the rest of the garment 100.

In some embodiments, the pocket 116 is positioned in a front pelvic region of the garment 100. In some embodiments, the pocket 116 is positioned in a lower back region of the garment 100. In some embodiments, there are multiple pockets 116. In some embodiments, there is a pocket 116 in the front pelvic region and a pocket 116 in the lower back region of the garment 100.

FIG. 3A shows a cross-sectional view of a waistband seam pocket portion 128*a* of the garment 100, according to some embodiments. FIG. 3B shows a cross-sectional view of a waistband seam non-pocket portion 128*b* of the garment 100, according to some embodiments.

The waistband 102 may include, for example, an outer layer 130 and an inner layer 132. The waistband 102 may include a single piece of textile folded over itself (e.g., along the upper edge 104) forming the outer layer 130 and the inner layer 132. Alternatively, separate pieces of textile may be used to form the outer layer 130 and the inner layer 132, with a connecting seam between the separate pieces positioned on the outer layer 130, on the inner layer 132, along the waistband upper edge 104, or any combination thereof (not illustrated).

The waistband 102 can be configured with a drawcord channel 133 configured to contain a drawcord 134. The drawcord channel 133 can be formed from the outer layer 130 or from the inner layer 132. The drawcord channel 133 can be formed by attaching an inner layer 132 to the outer layer 130 of the waistband 102. The drawcord channel 133 can be formed by folding a piece of fabric to form at least the waistband upper edge 104 and optionally to form an inner layer 132 and outer layer 130. The inner layer 132 and outer layer 130 may be attached (e.g., with attachment points 138 and/or 140 which may for example be attached by sewing or bonding) to form the drawcord channel 133. The drawcord channel 133 may be formed along an exterior or interior perimeter of the waistband 102. In some embodiments, there may be an anchor point provided within the drawcord channel 133 such that the drawcord 134 does not inadvertently get pulled out of the drawcord channel 133.

The drawcord channel 133 may may include one or more drawcord openings 135 (see FIG. 4A) to permit the drawcord 134 to be accessed and used (e.g., tightened or loosened). In some embodiments, the drawcord opening 135 may be on an outer surface of the waistband 102 (e.g., the drawcord opening 135 may extend through the outer layer 130). In some embodiments, the drawcord opening 135 may be on an inner surface of the waistband 102 (e.g., the drawcord opening 135 may extend through the inner layer 132). In some embodiments, the drawcord opening 135 may be contained within a pocket such that the drawcord 134 can be contained within and concealed by the pocket. The drawcord channel 133 may be formed on an inner surface of the waistband 102.

In some embodiments, the outer layer 130 of the waistband 102 may attach at a waistband lower edge 106. In some embodiments, the outer layer 130 can be folded to form an overhang 141 at the folded edge and below the waistband lower edge 106. Folding the outer layer 130 to form an overhang 141 below the waistband lower edge 106 can at least partially conceal the waistband seam 128, providing a smoother and more minimal appearance to the waistband area of the garment 100. The shell upper edge 114 may be attached to the waistband 102 at the waistband seam 128 at the waistband lower edge 106 beneath this overhang 141. Optionally, an upper liner edge 110 may also be attached to the waistband 102 at the waistband seam 128 at the waistband lower edge 106 beneath the overhang 141. Attaching one or more components in this way may permit the pocket opening 126 to be concealed under the overhang 141 of the waistband 102.

In some embodiments, the waistband 102 may further include elastic tape 136. The elastic tape 136 may extend circumferentially around the waistband 102. The elastic tape 136 may be positioned behind the outer layer 130 of the waistband 102. The elastic tape 136 may be positioned in front of the inner layer 132 of the waistband 102. The elastic tape 136 may be sandwiched between the outer layer 130 and the inner layer 132. Alternatively, the elastic tape may form at least a portion of the outer layer 130 of the waistband 102. The elastic tape 136 may provide the waistband 102 with some elasticity such that the waistband 102 may better fit against the wearer and secure the garment 100.

The elastic tape 136 may include two layers forming an open passage 136*a* at one edge of the elastic tape 136. In some embodiments, this open passage may include a Y-shaped end of the elastic tape 136. Such an open passage 136*a* opening toward the bottom of the elastic tape 136 may provide a channel in which the shell upper edge 114 and optionally the liner upper edge 110 can be attached with the waistband seam 128. One side of the open passage 136*a* (e.g., one of the arms of the Y-shape) can be inserted into the overhang 141 of the waistband 102 while the other side of the open passage 136*a* (e.g., the other arm of the Y-shape) can be provided on the innermost surface of the waistband 102 such that the two sides of the open passage 136*a* contain the liner upper edge 110 and the waistband lower edge 106 (and the shell upper edge 114 where attached), providing a durable point of attachment as well as a smooth appearance to the waistband seam 128. The elastic tape 136 can comprise one or more elastic filaments attached to or integrated with a textile, such as a woven or knit elastic tape.

The waistband 102 may be attached to the garment 100 differently depending on whether its along a waistband seam pocket portion 128*a* or a waistband seam non-pocket portion 128*b*. For example, FIG. 3A shows how the waistband 102 may be connected in the garment 100 in the waistband seam pocket portion 128*a*. Here, the waistband 102 may be attached to the liner 108 (e.g., where a pocket portion 121 forms at least a portion of the back panel 120 of the pocket 116) or to the liner 108 and the back pocket panel 120 (e.g., where the back pocket panel 120 is separate from the pocket portion 121 of the liner 108). The liner 108 may attach along a liner upper edge pocket portion 110*a* to the waistband 102 along a waistband lower edge pocket portion 106*a* with the waistband seam pocket portion 128*a*.

The shell 112 may be unattached along the waistband seam pocket portion 128*a* (or a portion thereof), forming the pocket opening 126. The shell 112 may be configured such that the shell upper edge pocket portion 114*a* is taut along the pocket opening 126. Alternatively, the shell upper edge 114 may be gathered in the shell upper edge pocket portion 114*a* (e.g., along the pocket opening 126), or in the shell upper edge non-pocket portion 114*b* (on one or both sides of the pocket opening 126), or in both the shell upper edge pocket portion 114*a* and the shell upper edge non-pocket portion 114*b*. This may be achieved by having the shell upper edge pocket portion 114*a* pulled taut when attaching the shell upper edge non-pocket portion 114*b* to the waistband seam 128. This may also be achieved by including an elastic textile in shell upper edge pocket portion 114*a* (e.g., a small elastic tape within the edge). Alternatively, using an elastic textile to form the front pocket panel 122 may provide the shell upper edge pocket portion 114*a* with sufficient stretch to enable the shell upper edge pocket portion 114*a* to remain taut and retract under the waistband overhang when not open.

In some embodiments, the shell 112 may be indirectly attached to the waistband seam pocket portion 128*a*, for example, through a closure. In some embodiments, one side of a closure (e.g., one side of a zipper 142) is attached at the waistband seam pocket portion 128*a* and the other side of the closure is attached to the shell upper edge pocket portion 114*a*.

The shell upper edge pocket portion 114*a* may be configured such that the pocket 116 is at least partially obscured beneath the waistband overhang 141 when the pocket 116 is not being accessed.

FIG. 3B shows how the waistband 102 may be connected to the garment 100 in the waistband seam non-pocket portion 128*a*. Here, the waistband 102 may be attached to the liner 108 (e.g., where a pocket portion 121 of the liner 108 forms the back panel 120 of the pocket 116) or to the liner 108 and the back pocket panel 120 (e.g., where the back pocket panel 120 is separate from the liner 108 and where the liner 108 is attached to the back pocket panel 120). Optionally, the liner 108 may attach along a liner upper edge non-pocket portion 110*b* to the waistband 102 along a waistband lower edge non-pocket portion 106*b* with the waistband seam non-pocket portion 128*b*. The waistband 102 may also be attached to the shell 112. The shell 112 may attach along a shell upper edge non-pocket portion 114*b* to the waistband 102 along a waistband lower edge non-pocket portion 106*b* with the waistband seam non-pocket portion 128*b*. Here too, there may be an overhang 141 formed from a folded edge at the bottom of the waistband 102 and beneath the waistband lower edge 106. The overhang 141 may partially conceal the attachment of the liner 108, shell 112, and waistband 102 by the waistband seam 128. In some embodiments, the waistband 102 may further include elastic tape 136 as described in greater detail above.

Figures 4A, 4B, 4C:
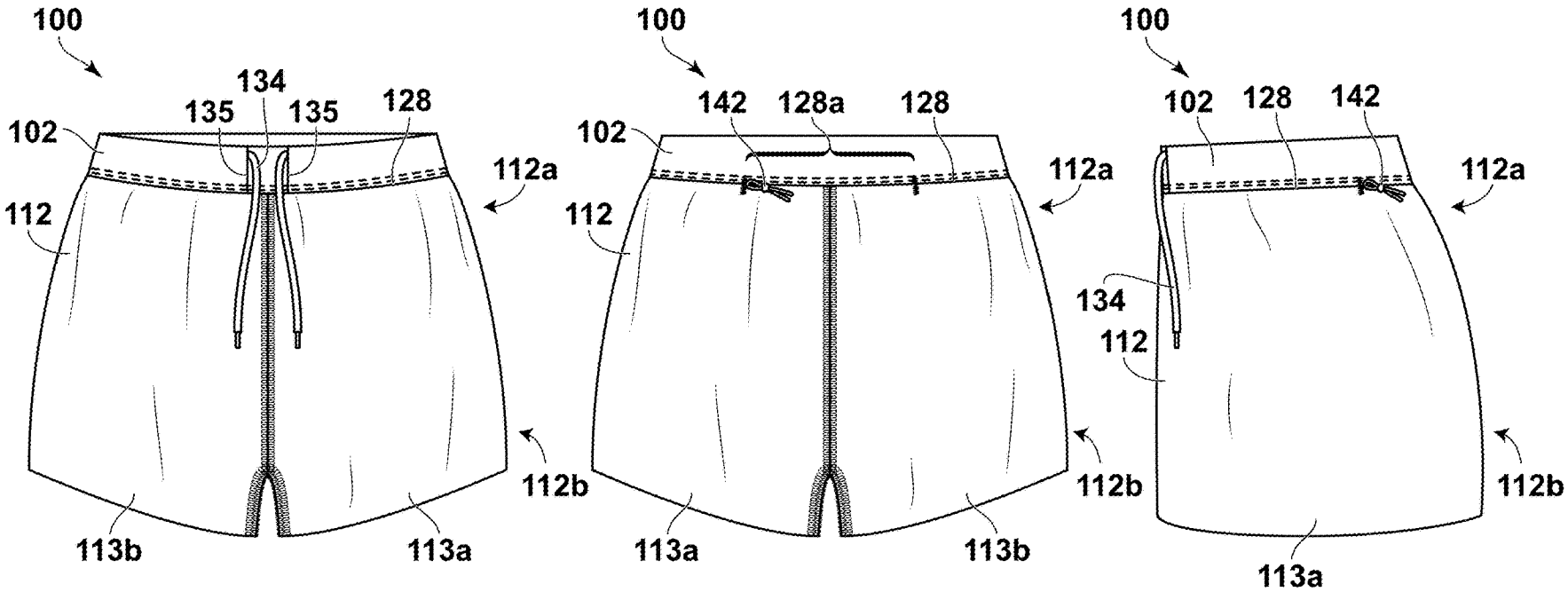
FIG. 4A, FIG. 4B, and FIG. 4C show a front view, rear view, and side view respectively of the garment of FIG. 1A, according to some embodiments.

FIG. 4A, FIG. 4B, and FIG. 4C show a front view, rear view, and side view respectively of the garment 100, according to some embodiments.

The systems described herein can be provided in many different types of garments 100, such as a short, pant, trouser, legging, tight, skirt, or skort. The pant, trouser, legging or tight may be cropped or uncropped. As described above, the waistband 102 may include a drawcord channel 133 which may contain a drawcord 134 which may exit the waistband 102 at the drawcord opening 135. The example illustrated has a drawcord channel 133 that extends along the full perimeter of the waistband 102 of garment 100 and the drawcord 134 can be inserted in one drawcord opening 135 and pulled through the perimeter and pulled out the opposite drawcord opening 135. In other configurations, the drawcord channel 133 and drawcord 134 may extend along only a portion of the perimeter of the waistband 102 of garment 100, such as only along the front of the waistband 102 of garment 100 or only along the back of the waistband 102 of garment 100. Other configurations are also conceived.

The pockets 116 described herein can be integrated into the rear of a garment 100 such that the pocket 116 generally sits against the rear of the wearer such as near the lower back (as illustrated). Such a pocket 116 may be convenient to contain larger contents (e.g., a phone). In some embodiments, the pocket 116 may be integrated along the front such as near the front pelvic region (not pictured). In some embodiments, the pocket 116 may be integrated along the sides (not pictured). Side pockets may be suitable for smaller items (e.g., keys). Garments 100 according to the teachings described herein may further be configured to include a plurality of pockets 116 (e.g., along one or more of the rear, sides, and front).

The pocket opening 126 may generally align with the waistband seam pocket portion 128*a* such that its appearance is reduced. Configuring the pocket opening 126 to be near the waistband seam 128 can ensure that the pocket opening is easily identifiable by the wearer. For example, the waistband 102 will generally fit securely on the wearer such that the wearer can easily reach around to the rear of the waistband 102 and feel down to the pocket opening 126. This may be of particular importance for a rear pocket (such as the one illustrated) which may not be easy to see. This may also be of particular importance for athletic garment 100 or garments 100 where the wearer may want to access the contents of the pocket 116 while engaged in another activity, particularly if that activity may generally cause movement in the garment 100 (e.g., running).

It may be beneficial to have a pocket opening 126 in the shell 112 as it can allow the wearer to access the contents of the pocket 116 during use without lifting the shell 112. It may also be beneficial to have a pocket opening 126 along the waistband seam 128 as the movement in the shell 112 proximate to the waistband 102 will be limited by the waistband 102 (whereas a pocket opening further down the shell 112 may bounce about or shift during wear owing to the looser fit of the shell 112).

Figure 5B:
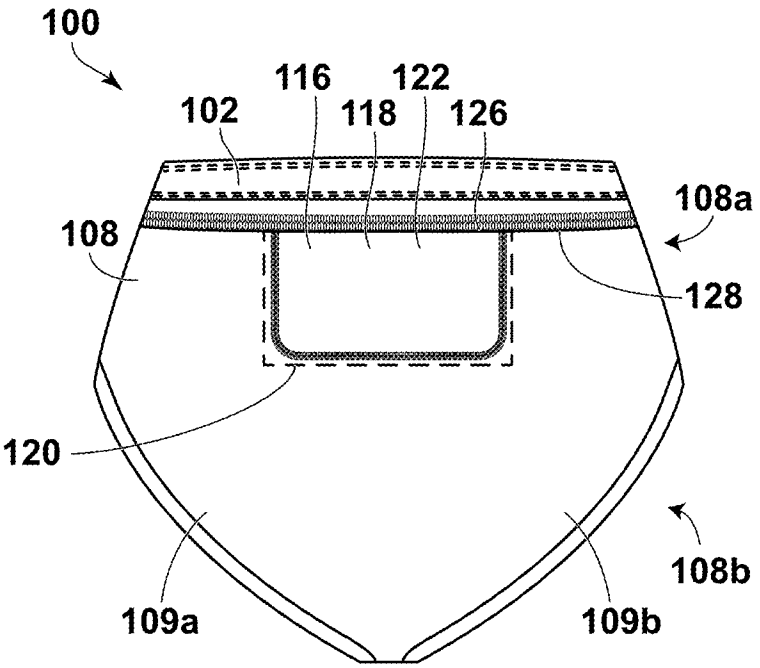
FIG. 5A and FIG. 5B show a front view and a rear view respectively of the liner of the garment of FIG. 1A, according to some embodiments.
Figure 5A:
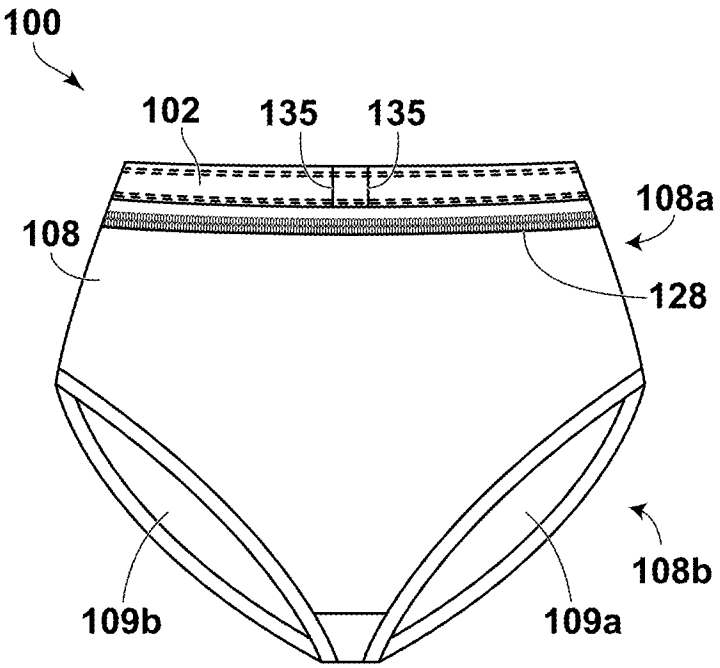

FIG. 5A and FIG. 5B show a front view and a rear view respectively of the liner 108 of the garment 100, according to some embodiments.

As described above, the liner 108 can comprise or consist of a liner upper portion 108*a*, and can take many forms. As illustrated in FIG. 2B, FIG. 5A, and FIG. 5B, the liner 108 may include a liner body portion 108*b* and may include leg portions 109*a* and 109*b* when the liner 108 takes the form of panties or briefs. In these embodiments, the liner body portion 108*b* includes leg portions 109*a* and 109*b* which extend down the liner body portion 108*b* (e.g., wherein the leg portions 109*a* and 109*b* have an inseam). As also described above, the shell 112 may cover the entirety of the liner 108. In some embodiments, the leg portions 109*a* and 109*b* of the liner 108 may extend past the leg portions 113*a* and 113*b* of the shell 112 such that they are generally visible when worn (not pictured).

Figure 6:
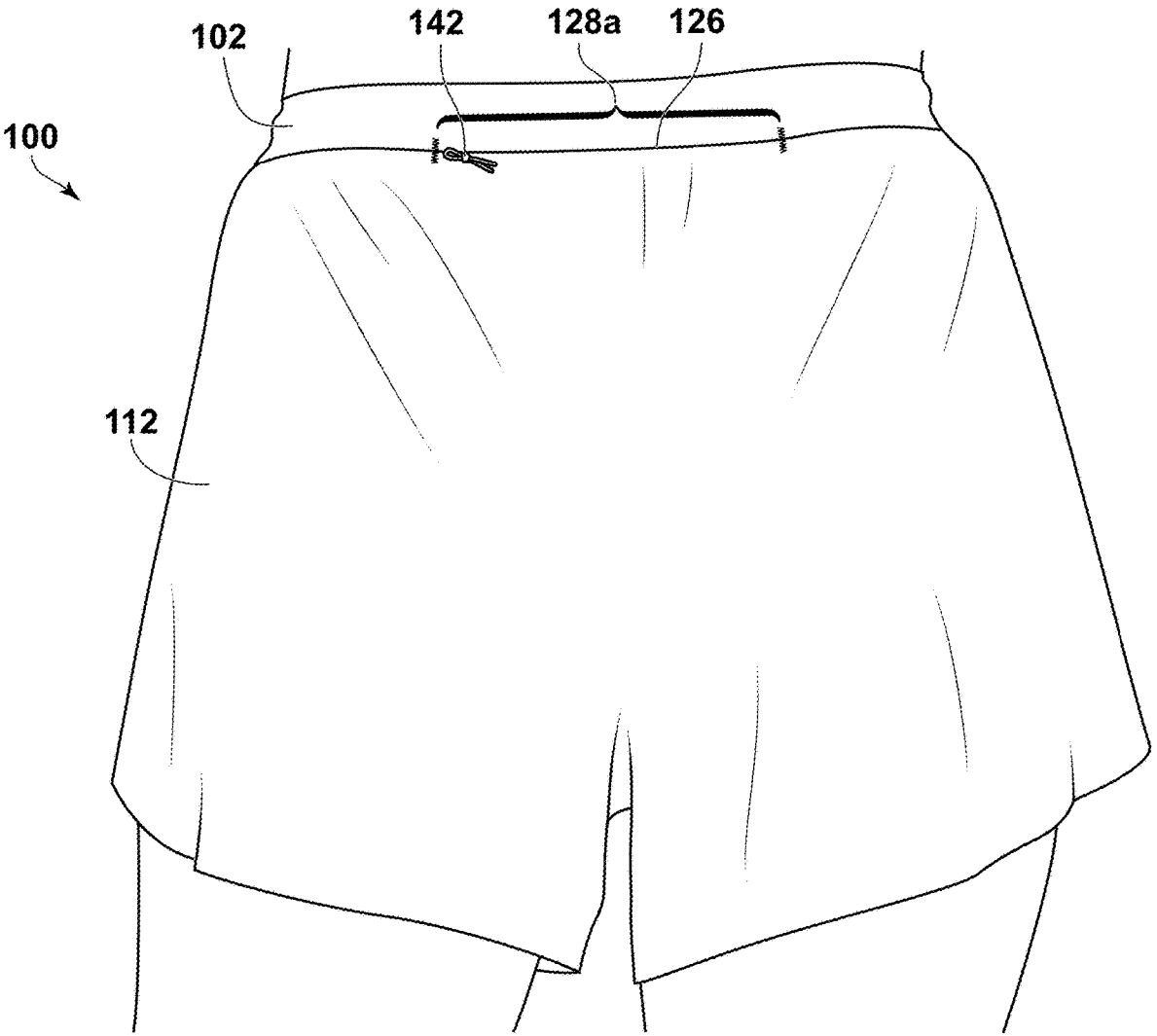
FIG. 6 shows the pocket opening of the garment of FIG. 1A when worn, according to some embodiments.

FIG. 6 shows the pocket opening 126 of the garment 100 when worn, according to some embodiments.

This garment 100 illustrates that the pocket opening 126 is discretely provided along the waistband seam pocket portion 128*a*. In addition to garment 100 providing a pocket 116 with an unobtrusive pocket opening 126, the configuration of garment 100 can reduce the number of seams required to construct the garment 100 which may be advantageous from a manufacturing standpoint. For example, there may be less sewing or bonding required which may reduce the complexity of manufacturing and the number of different materials needed. It may also reduce the need to align additional attachment points during manufacturing which may reduce the likelihood of producing rejected garments (e.g., garments 100 which do not conform to the manufacturing plan).

The garment 100 may be configured to be worn during activities. For example, the garment 100 may be configured for wear during athletic activities (running, hiking, yoga, etc.) or may be configured for wear during strenuous work (e.g., work wear, gardening activities, etc.). Accordingly, it may be beneficial to provide storage for the wearer that is easily accessible. Providing the pocket 116 on the rear may be beneficial as it may provide a longer waistband 102 portion that is generally flat (as compared to the sides) and may be more out of the way from moving body parts (e.g., not along the front where it may interfere with leg movements while running or bending).

In some embodiments, the waistband 102, the liner 108, and/or the shell 112 (or parts thereof) may be made from a knit fabric, a woven fabric, or a non-woven fabric. The fabric can comprise natural fibers or filaments, man-made fibers or filaments, or synthetic fibers or filaments, or any combination thereof. The fabric can comprise a blend of natural fibers or filaments and man-made fibers or filaments, such as a blend of cotton and modal or a blend of cotton and polyester. The natural fibers can comprise cellulose-based fibers such as cotton or linen. The natural fibers or filaments can comprise protein-based fibers or filaments such as wool or silk. The man-made fibers or filaments can comprise regenerated cellulose-based fibers or filaments such as rayon, modal or lyocell. The synthetic fibers or filaments can comprise one or more synthetic polymers such as a polyester, a polyether, a polyamide, a polyimide, a polyacrylic, a polyolefin, or any combination thereof. The synthetic fiber or filament can comprise a polyester fiber or filament, such as a polyethylene terephthalate (PET) fiber or filament, a polytrimethylene terephthalate (PTT) fiber or filament, or a bicomponent PET-PTT fiber or filament. The synthetic fiber or filament can comprise a polyamide fiber or filament, such as a nylon 6 fiber or filament or a nylon 11 fiber or filament or a nylon 6,6 fiber or filament. The fabric can be an elasticated fabric such as a fabric comprising one or more elastane filament. The elasticated fabric can have two-way stretch or can have four-way stretch. In some embodiments the waistband 102, the liner 108, and/or the shell 112 may be made from a combination of different fabrics or a combination of different fibers or filaments.

Figure 7:
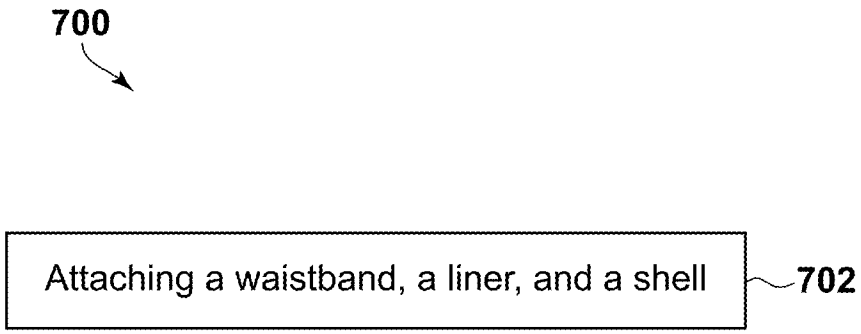
FIG. 7 is a process diagram of an example method of manufacturing the garment of FIG. 1A, according to some embodiments.

FIG. 7 is a process diagram of an example method 700 of manufacturing the garment 100, according to some embodiments.

According to an aspect, there may be provided a method 700 of manufacturing the garment 100. The method 700 may include attaching a waistband 102, a liner 108, and a shell 112 (block 702). The waistband 102, the liner 108, and the shell 112 may generally be attached using a waistband seam 128. The waistband seam 128 may be applied differently depending on whether it is the waistband seam pocket portion 128*a* or the waistband seam non-pocket portion 128*b*. For example, the waistband 102, the liner 108, and the shell 112 may be attached in the waistband seam non-pocket portion 128*b* whereas only the waistband 102 and the liner 108 (and a relevant back pocket panel 120) may be attached in the waistband seam pocket portion 128*a*. The shell 112 and the front pocket panel 122 may be attached along a shell upper edge pocket portion 114*a*. In some embodiments, the liner 108 may be attached to other components with the waistband seam 128 along the liner upper edge 110. In some embodiments, the waistband seam 128 may attach the liner 108 below the liner upper edge (e.g., the liner 108 may extend above the waistband seam 128, for example, to the waistband upper edge 104).

While particular elements, embodiments and applications of the present disclosure have been shown and described, it will be understood, that the scope of the disclosure is not limited thereto, since modifications can be made by those skilled in the art without departing from the scope of the present disclosure, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another or may be combined in various ways. All possible combinations and sub combinations are intended to fall within the scope of this disclosure.

Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the inventions described herein.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

As can be seen therefore, the examples described above and illustrated are intended to be exemplary only. The scope is indicated by the appended claims.

What is claimed is:

1. A lower body garment comprising:

a waistband configured to be positioned around a waist of a wearer, wherein the waistband comprises a waistband upper edge and a waistband lower edge, the waistband upper edge defines a waist opening of the lower body garment, and the waistband lower edge comprises a waistband lower edge pocket portion and a waistband lower edge non-pocket portion;

a liner defining an innermost surface of the lower body garment, wherein the liner is configured to cover a lower torso area below a waist area of a wearer, wherein the liner comprises a liner pocket portion;

a shell defining an outermost surface of the lower body garment and covering at least a portion of the liner below the waistband lower edge, the shell comprising a shell upper edge, and the shell upper edge comprising a shell upper edge pocket portion and a shell upper edge non-pocket portion;

a pocket configured to contain contents in the lower body garment, wherein the pocket comprises a pocket bag that includes:

a back pocket panel formed from the liner pocket portion or attached to the liner pocket portion, a front pocket panel opposite the back pocket panel, a pocket opening along an edge of the front pocket panel and proximate to the shell upper edge pocket portion, and a closed pocket perimeter attaching the front pocket panel and the back pocket panel to each other and defining closed edges of the pocket bag, wherein the pocket bag is configured to contain the contents in an area between the front pocket panel and the back pocket panel within the closed pocket perimeter;

wherein the lower body garment comprises a waistband seam, the waistband seam includes a waistband seam pocket portion and a waistband seam non-pocket portion, the waistband seam non-pocket portion connects the waistband lower edge non-pocket portion with the shell upper edge non-pocket portion, and the waistband seam pocket portion connects the waistband lower edge pocket portion with the back pocket panel;

wherein the front pocket panel is positioned between an inward-facing surface of the back pocket panel and an opposing inward-facing surface of the shell; and wherein an upper edge of the front pocket panel is attached to the shell upper edge pocket portion, the pocket opening is positioned along the waistband seam pocket portion, and the pocket opening is configured to provide access to the pocket bag from the outermost surface of the shell.

2. The lower body garment of claim 1, wherein the liner comprises a first elastic textile having a stretch axis aligned with the waist opening.

3. The lower body garment of claim 1, wherein the back pocket panel is formed from the liner pocket portion, the liner comprises a first elastic textile having an axis of stretch aligned with the waist opening, and the front pocket panel comprises a second elastic textile having an axis of stretch aligned with the waist opening.

4. The lower body garment of claim 1, wherein the back pocket panel is attached to the liner, the liner comprises a first elastic textile having an axis of stretch aligned with the waist opening, and the front pocket panel comprises a second elastic textile having an axis of stretch aligned with the waist opening.

5. The lower body garment of claim 1, wherein the pocket opening comprises a closure movable between an open position and a closed position.

6. The lower body garment of claim 1, wherein the waistband comprises a waistband outer layer defining an outermost surface of the waistband and the waistband outer layer wraps over the waistband upper edge.

7. The lower body garment of claim 6, wherein the waistband outer layer forms a drawcord channel, the waistband includes a drawcord in the drawcord channel, and the drawcord channel includes a drawcord opening configured to provide access to the drawcord.

8. The lower body garment of claim 1, wherein the waistband comprises a waistband inner layer defining an innermost surface of the waistband; the waistband inner layer forms a drawcord channel along an interior perimeter of the waistband, the waistband includes a drawcord in the drawcord channel, and the drawcord channel includes a drawcord opening configured to provide access to the drawcord.

9. The lower body garment of claim 1, wherein the waistband comprises a length of elastic tape extending circumferentially around the waist opening.

10. The lower body garment of claim 1, wherein the pocket is in a front pelvic area of the lower body garment configured to cover at least a portion of a front pelvic area of a wearer, or is in a lower back area of the lower body garment configured to cover at least a portion of a lower back area of a wearer.

11. The lower body garment of claim 1, wherein the shell upper edge pocket portion is not gathered along the waistband seam.

12. The lower body garment of claim 1, wherein the shell upper edge pocket portion is gathered along the waistband seam.

13. The lower body garment of claim 1, wherein the pocket bag is positioned below the waistband seam.

14. The lower body garment of claim 1, wherein the liner includes a liner waistband attached to a liner upper edge, and an upper edge of the liner waistband is adjacent the waistband upper edge.

15. The lower body garment of claim 1, wherein the liner includes a liner upper edge, and the liner upper edge is adjacent to the waistband upper edge.

16. The lower body garment of claim 1, wherein the liner includes a liner upper edge, the liner upper edge is adjacent the waistband lower edge, and the liner upper edge comprises a liner upper edge pocket portion and a liner upper edge non-pocket portion.

17. The lower body garment of claim 1, wherein the lower body garment is one or more of a short, pant, trouser, legging, tight, skirt, or skort; optionally wherein the lower body garment is the pant, trouser, legging or tight, and the pant, trouser, legging or tight is a cropped pant, trouser, legging or tight.

18. A lower body garment comprising:

a waistband configured to be positioned around a waist of a wearer, wherein the waistband comprises a waistband outer layer defining an outermost surface of the waistband, a waistband upper edge, and a waistband lower edge, the waistband upper edge defines a waist opening of the lower body garment, the waistband outer layer wraps over the waistband upper edge and forms a drawcord channel along an interior perimeter of the waistband, and the waistband lower edge comprises a waistband lower edge pocket portion and a waistband lower edge non-pocket portion;

a liner defining an innermost surface of the lower body garment, wherein the liner is configured to cover a lower torso area below a waist area of a wearer, wherein the liner comprises a liner pocket portion, wherein the liner comprises a first elastic textile having a stretch axis aligned with the waist opening;

a shell defining an outermost surface of the lower body garment and covering at least a portion of the liner below the waistband lower edge, the shell comprising a shell upper edge, and the shell upper edge comprising a shell upper edge pocket portion and a shell upper edge non-pocket portion;

a pocket configured to contain contents in the lower body garment, wherein the pocket comprises a pocket bag that includes:

a back pocket panel formed from the liner pocket portion, a front pocket panel opposite the back pocket panel, a pocket opening along an edge of the front pocket panel and proximate to the shell upper edge pocket portion, and a closed pocket perimeter attaching the front pocket panel and the back pocket panel to each other and defining closed edges of the pocket bag, wherein the pocket bag is configured to contain the contents in an area between the front pocket panel and the back pocket panel within the closed pocket perimeter;

wherein the lower body garment comprises a waistband seam, the waistband seam includes a waistband seam pocket portion and a waistband seam non-pocket portion, the waistband seam non-pocket portion connects the waistband lower edge non-pocket portion with the shell upper edge non-pocket portion, and the waistband seam pocket portion connects the waistband lower edge pocket portion with the liner upper edge pocket portion, and includes the pocket bag extending along the liner from the waistband seam pocket portion to below the waistband seam pocket portion;

wherein the front pocket panel is positioned between an inward-facing surface of the back pocket panel and an opposing inward-facing surface of the shell; and wherein an upper edge of the front pocket panel is attached to the shell upper edge pocket portion, the pocket opening is positioned along the waistband seam pocket portion, and the pocket opening is configured to provide access to the pocket from the outermost surface of the shell.

19. A method of manufacturing a lower body garment, the method comprising: affixing a waistband, a liner, and a shell to each other, wherein the waistband, the liner, and the shell are the waistband, the liner, and the shell according to claim 1.

20. A lower body garment manufactured according to the method of claim 19.

* * * * *